US006076250A

United States Patent [19]

Spitzer

[11] Patent Number: 6,076,250

[45] Date of Patent: Jun. 20, 2000

[54] PROCESS FOR PRODUCING A HEALD SHAFT FOR WEAVING SHAFTS OUT OF A METAL HOLLOW SECTION

[75] Inventor: Manfred Spitzer, Borken, Germany

[73] Assignee: Firma Schmeing GmbH & Co., Borken, Germany

[21] Appl. No.: 09/011,936

[22] PCT Filed: Jan. 10, 1997

[86] PCT No.: PCT/DE97/00078

§ 371 Date: Feb. 17, 1998

§ 102(e) Date: Feb. 17, 1998

[87] PCT Pub. No.: WO97/25465

PCT Pub. Date: Jul. 17, 1997

[30] Foreign Application Priority Data

Jan. 13, 1996 [DE] Germany ..... 196 01 116
Jun. 22, 1996 [DE] Germany ..... 196 25 076

[51] Int. Cl.[7] ..... B23P 13/04

[52] U.S. Cl. ..... 29/557; 72/254; 139/52; 139/93

[58] Field of Search ..... 72/370.1, 370.13, 72/370.27, 254, 340; 139/48, 52, 55.1, 93; 29/557

[56] References Cited

U.S. PATENT DOCUMENTS

| | | | |
|---|---|---|---|
| 9,603 | 3/1853 | Townshend . | |
| 1,091,751 | 3/1914 | Mogan et al. | 72/370.1 |
| 3,088,496 | 5/1963 | Houghton et al. . | |
| 3,754,429 | 8/1973 | Creuzet | 72/370.13 |
| 3,754,577 | 8/1973 | Heller . | |
| 3,779,288 | 12/1973 | Budzyna . | |
| 3,841,358 | 10/1974 | Svaty et al. . | |
| 4,091,844 | 5/1978 | Underwood . | |
| 4,417,462 | 11/1983 | Palovcik | 72/370.1 |
| 5,040,571 | 8/1991 | Klocker et al. . | |
| 5,398,989 | 3/1995 | Winter et al. | 29/557 |
| 5,412,860 | 5/1995 | Miyauchi et al. | 29/557 |
| 6,029,353 | 2/2000 | Cowan | 72/254 |

FOREIGN PATENT DOCUMENTS

| | | |
|---|---|---|
| 258224 | 11/1967 | Austria . |
| 0 239 013 | 9/1987 | European Pat. Off. . |
| 1.498.551 | 1/1968 | France . |

*Primary Examiner*—David P. Bryant
*Attorney, Agent, or Firm*—Merchant & Gould P.C.

[57] ABSTRACT

The invention concerns a process for producing a heald shaft for weaving shafts out of a metal hollow section, the height of which diminishes towards the ends on both sides. A light-weight extruded metal section is selected and adjusted to the maximal height of the section of a heald shaft without center support, whereupon the heald shaft is reduced towards both of its ends.

8 Claims, 1 Drawing Sheet

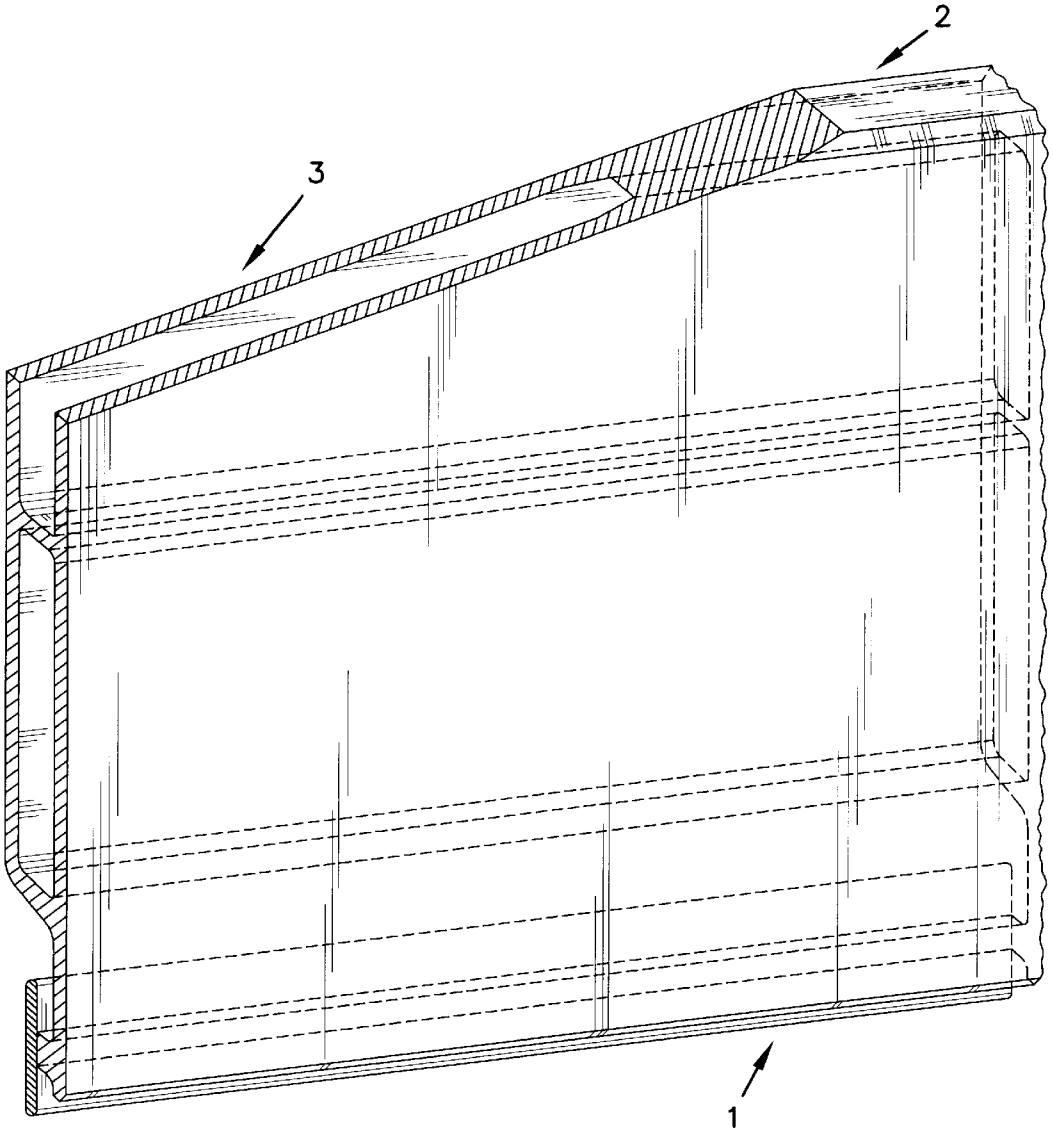
2
3
1

PROCESS FOR PRODUCING A HEALD SHAFT FOR WEAVING SHAFTS OUT OF A METAL HOLLOW SECTION

FIELD OF THE INVENTION

The invention concerns a process for manufacturing a heald shaft for weaving shafts in correspondence with the generic term of the main claim.

BACKGROUND OF THE INVENTION

Light-weight and rigid weaving shafts are necessary for high-performance looms with up to 2000 fills/min. Acceleration values which permit the highest weft efficiency with an economical justifiable energy consumption are attainable only with light-weight weaving shaft heald systems. For a trouble-free weaving process, heald shafts must be as rigid as possible.

In the past, weaving shaft design has been adapted to the progressing increase in loom efficiency essentially by increasing the height of the heald shaft cross section for decreasing the severity of sagging. Since extruded sections are usually employed for the heald shafts, this approach is subject to limitations because of the associated considerable increase in the weight of the sections. A further increase in weaving shaft weight necessitates more powerful drive units for the weaving shafts and a considerably higher energy consumption, and thus renders further increases in weft efficiency uneconomical.

In DE 39 37 657 A 1, it is shown that weaving shafts with heald shafts consisting of carbon fiber or carbon fiber hybrid materials are currently employed for solving this problem. Decided advantages are light weight and high flexural strength because of the high elastic modulus, in comparison with an extruded aluminum section of equal height. Serious disadvantages of this proposal are the high price, which is several times that of a comparable aluminum section, as well as the unsolved problem of disposal of worn-out weaving shafts.

In the following references, that is, EP 496 054 A 1, DE 36 21 145 A 1, and DE 37 02 524 C 2, a different solution is proposed for the problem; that is, the upper and lower heald shafts of the proposed weaving shafts consist of a combination of steel sections, thin steel sheets, and light-weight frame structures. Weaving shafts produced from these sections are somewhat lighter than comparable aluminum weaving shafts, but the flexural strength is somewhat lower, and the price is about twice as high.

Finally, in U.S. Pat. No. 3,754,577, the addition of planking with rails or sheets of steel or carbon fibers in partial zones of extruded sections is proposed for increasing the flexural strength.

All of these proposed and in part practiced problem solutions ignore the state of the art, which implies that a beam on two supports should logically exhibit the highest geometrical moment of inertia in the zone of highest stresses.

In Austrian Patent 25 82 24, the insertion of a single hollow section of steel or aluminum as basis heald shaft with relatively low overall height is proposed for this purpose. By means of webs fastened to the back of the heald shaft, for instance, with screws or rivets, or by welding, whose height increases from the ends of the section toward the middle, higher flexural strength is envisaged and achieved with the least possible increase in weight. The web height in the middle can vary in correspondence with the length of the weaving shaft, or in correspondence with the load. However, this inherently ideal weaving shaft design also has not proved its worth in practice because of the cost, since the manufacturing process is evidently too expensive, and adaptation to match the wide variety of possible applications presents difficulties.

Another solution provides for one or more so-called central supports, which are frequently inserted between the upper and lower shaft sections for weaving shaft lengths as of 250 cm nominal width, if greater shaft weight is not tolerable. These central supports are an extremely unpleasant means of reducing the sag of the section, since they hinder manipulation in healding and frequently result in weaving defects and track during the weaving process.

The purpose of the present invention is to produce a weaving shaft which does not require a central support, even for large machine widths; at the same time, the weight of the weaving shaft must remain within the limits specified by loom and shaft machine manufacturers; finally, an economical manufacturing process which permits the use of recyclable materials is proposed.

SUMMARY OF THE INVENTION

The invention involves a process for manufacturing a heald shaft for weaving shafts. The heald shaft made according to the invention is made from an hollow metal section that has been tapered at both lateral ends. The process includes steps of extruding a light metal section with a desired section height and subsequently tapering both ends of the extruded light metal section.

BRIEF DESCRIPTION OF THE FIGURES

The FIGURE illustrates a portion of a heald shaft made in accordance with the process of the invention.

DETAILED DESCRIPTION

The FIGURE illustrates the heald shaft made according to the invention. Seen in the FIGURE is a portion 1 of a heald shaft. The maximum section height is noted at 2, while an open chamber made by tapering the shaft is seen at 3.

In other words, the use of an extruded light metal section as heald shaft is proposed; its height thereby corresponds to the necessary maximal section height of the heald shaft. That is, the basis section must be as high as necessary for assuring acceptable sag of the heald shaft in the middle. The section height thus determined for a weaving shaft without central support is considerably greater than for the sections usually employed at present for heald shafts with central support. Furthermore, it is proposed that this relatively high heald shaft be tapered from the middle toward both ends, in order to decrease the weight without impairing the dynamic performance of the heald shaft.

A single-component extruded section, preferentially of aluminum, which requires no further machining other than tapering toward the ends, is proposed.

Since the shaft sections in part have open section chambers as a result of tapering for the purpose of weight reduction, these open chambers are closed with light materials on the upper heald shaft, if necessary; this measure ensures that no accumulations of fiber flocks can form in the open back of the section during cotton weaving, for instance, and fall into the woven materials at any time, thus causing malfunctions or weaving defects.

The additional, preferentially cutting machining for decreasing the section weight can be performed economically in a chucking operation in the course of the other machining processes at a programmable central machining facility.

The additional material consumption for the higher extruded section causes only a fraction of the costs which would otherwise result from the use of complicated section structures of hybrid design, of carbon fibers, or elaborate reinforcement measures.

What is claimed is:

1. Process for manufacturing a heald shaft for weaving shafts from a hollow metal section, whose height decreases toward both ends, the process comprising steps of:

extruding a light metal section having a section height selected to match the maximal section height of a heald shaft without central support; and tapering both lateral ends of the light metal section.

2. Process as claimed in claim 1, wherein the step of tapering both lateral ends of the light metal section comprises a machining step.

3. Process as claimed in claim 2, wherein the machining step comprises a step of producing open section chambers.

4. Process as claimed in claim 3, further comprising a step of closing the open section chambers produced in the upper heald shaft by machining.

5. Process as claimed in claim 4, wherein the closing step comprises using lightweight materials.

6. A heald shaft for weaving shafts, the heald shaft comprising an extruded hollow light metal shaft having a section height selected to match the maximal height of a heald shaft without central support; wherein the light metal shaft tapers at each lateral end.

7. The heald shaft as claimed in claim 6, further comprising open section chambers produced by machining the extruded light metal shaft.

8. The heald shaft as claimed in claim 7, wherein the open section chambers are closed with lightweight materials.

* * * * *